US005978006A

United States Patent [19]

Morgavi

[11] Patent Number: 5,978,006

[45] Date of Patent: Nov. 2, 1999

[54] THERMAL DYE TRANSFER PRINTING METHOD WITH ELECTRICAL LOSS COMPENSATION

[75] Inventor: Paul Morgavi, La Ciotat, France

[73] Assignee: Gemplus, Gemenos, France

[21] Appl. No.: 08/930,331

[22] PCT Filed: Mar. 28, 1996

[86] PCT No.: PCT/FR96/00473

§ 371 Date: Sep. 25, 1997

§ 102(e) Date: Sep. 25, 1997

[87] PCT Pub. No.: WO96/31352

PCT Pub. Date: Oct. 10, 1996

[30] Foreign Application Priority Data

Apr. 4, 1995 [FR] France ..... 95/04286

[51] Int. Cl.[6] ..... B41J 2/355

[52] U.S. Cl. ..... 347/192; 347/190; 400/120.1

[58] Field of Search ..... 347/192, 190; 400/120.1, 120.12

[56] References Cited

U.S. PATENT DOCUMENTS

| | | | |
|---|---|---|---|
| 4,168,421 | 9/1979 | Ito | 219/216 |
| 4,407,003 | 9/1983 | Fukui | 346/76 |
| 4,434,354 | 2/1984 | Nakata | 219/216 |
| 5,499,878 | 3/1996 | Morgavi | 400/223 |
| 5,536,328 | 7/1996 | Morgavi | 134/6 |

FOREIGN PATENT DOCUMENTS

| | | |
|---|---|---|
| PCT/FR96/00999 | 6/1996 | France . |
| PCT/FR96/01000 | 6/1996 | France . |
| 60-155475 | 8/1985 | Japan . |
| 62-59053 | 3/1987 | Japan . |
| 53-01370 | 11/1993 | Japan . |
| 70-61021 | 3/1995 | Japan . |
| 70-68825 | 3/1995 | Japan . |

*Primary Examiner*—N. Le
*Assistant Examiner*—Anh T. N. Vo
*Attorney, Agent, or Firm*—Nilles & Nilles, S.C.

[57] ABSTRACT

A thermal printing method using a printing head (6, 20) with a plurality of resistive points ($P_i$) activated by the pulses of a supply voltage (Va) that fluctuates (ΔV) depending on the number (N) of simultaneously activated resistive points ($P_i$). The activation of the resistive points ($P_i$) is controlled by a control signal (STRB) with a duration determined so that the energy (e) delivered to the resistive points ($P_i$) by each pulse is unaffected by the fluctuations (ΔV) of the supply voltage (Va). The control signal (STRB) includes a first pulse (STRA) with a fixed, predetermined duration (To), followed by a second pulse (STRA+) with a variable duration (t), the duration (t) of the second pulse (STRA+) being determined during the duration (To) of the first pulse (STRA) depending on the actual value (V) of the supply voltage (Va).

21 Claims, 2 Drawing Sheets

THERMAL DYE TRANSFER PRINTING METHOD WITH ELECTRICAL LOSS COMPENSATION

BACKGROUND OF THE INVENTION

1. Field of the Invention

The present invention relates to a method of thermal printing by the deposition of dyes.

2. Description of the Related Art

The present invention relates more particularly to a method of continuous-tone dye diffusion printing of the type described in the articles by P. W. Webb and R. A. Hann, <<Measurement of thermal transients in a thermal print head used for dye diffusion color printing>> in IEEE Proceedings-A Vol. 138, No. 1, January 1991, and A. Kaneko, <<A Simple Simulation for Simultaneous Diffusion of Dye and Heat in Dye Diffusion Thermal Transfer Printing>>, in Journal of Imaging Science, volume 35, No. 4, July/August 1991.

A method of this kind, which can be used to achieve high-quality printing, can be applied in particular to the customization of plastic cards such as smart cards, magnetic cards, badges, etc.

FIG. 1 shows a printing device 1 according to this method, designed for the customizing of plastic cards of a known kind as already described in the French patent applications No. 90 14329 or No. 94 02116 filed on behalf of the present Applicant.

In very broad terms, the printing device 1 comprises two pairs 2, 3 of secondary rollers for the conveyance of a plastic card 4 to be printed, a main conveyance and printing roller 5, a print head 6 of which only the useful bar-shaped end is shown, an inking ribbon 7 with three sequences of dyes of primary colors, generally yellow, (J), magenta (M) and cyan blue (C). The card 4 is sandwiched between the print head 6 and the main roller 5 with the interposition of the inking ribbon 7. The card 4 moves step by step in a printing direction S identified in FIG. 1 and, to each shift of the card, there corresponds an equivalent shift of the inking ribbon 7 and the printing of a line. Thus, the printing of a pattern proceeds line by line for a first primary color sequence until the entire length of the card is crossed, then the card returns to the initial position for the printing of a second primary color sequence etc. After three printing sequences, a full range of colors is obtained by the combination of the three primary colors.

FIG. 2 shows the lower face of the print head 6 in contact with the ribbon 7, and FIG. 3 gives a schematic view of the electrical structure of the print head 6. Together, these two figures provide for a clearer understanding of the printing mechanism.

As can be seen FIG. 2, the print head 6 includes a row of n heating resistive points $P_i$ ($P_1$, P2, . . . $P_n$), i being a index ranging from 1 to n. For the printing of a line, each resistive point $P_i$ is activated by a train of voltage pulses of the same duration, and is thus brought up to a temperature of diffusion of the dye coating the ribbon 7, namely a temperature of about 200° C. to 300° C. Each resistive point $P_i$ thus ensures the printing of a pixel, the set of pixels constituting a line. Of course, when an pixel should not be printed, the corresponding resistive point $P_i$ is not activated.

In FIG. 3, it can be seen schematically that the constant-duration voltage pulses providing for the activation of the resistive points $P_i$ are applied by means of a plurality of switches $I_i$ ($I_1$, $I_2$, . . . $I_n$) connected to a source 8 of voltage Va by means of an electrical cable 9. The switches $I_i$ are controlled by an electronic circuit 11 that opens and closes them alternately. Since the quantity of dye deposited on the card by diffusion (the term <<migration>> is also used) is a function of the temperature of the resistive points $P_i$, the electronic circuit 11, depending on the image to be printed, determines the number of voltage Va pulses that should be applied to each resistive point $P_i$. The quantity of primary color deposited for each pixel is thus modulated, making it possible to obtain a large variety of shades of colors after the combination of the three primary colors.

In view of the above, it can be understood that, to print a pattern with a constant intensity of color, it suffices in principle to apply the same number of electrical pulses to the resistive points $P_i$ concerned, at each printing of a line. However, in practice, this result is not obtained and variations in color intensity occur depending on the shape of the printed pattern. For example if, as shown in FIG. 4, a gradually widening strip is printed on a card 4, then it is observed that as the strip widens, the color deposited becomes lighter. In general, it can be seen that the intensity of the color becomes smaller as the width of the printed pattern increases.

Such variations in color intensity originate in an problem that is electrical in nature. More specifically, when the printing of a line requires that a large number of resistive points $P_i$ should be activated at the same time (for large-sized patterns), a major current draw takes place in the voltage source 8 and the voltage Va provided to the print head 6 decreases appreciably. A voltage drop of this kind is due to various electrical losses by Joule effect between the source 8 and the print head 6, especially in the cable 9 which has a considerable length because of practical imperatives. Conversely, when the printing of a line requires the activation of only a small number of resistive points (for a small-sized pattern), the current is weak and the voltage drop is negligible.

To mitigate this drawback, there has already been proposed a thermal printing method using a print head that comprises a plurality of resistive points activated by pulses of a supply voltage liable to fluctuate as a function of the number of simultaneously activated resistive points, in which the activation of the resistive points is controlled by a control signal whose duration is determined so that the energy provided to the resistive points by each of the voltage pulses is appreciably constant and independent of the fluctuations of the supply voltage. A method of this kind is described by the U.S. Pat. No. 4,434,354.

However, for its implementation, this prior art method requires the designing of a relatively complex switch-over circuit that is sensitive to the supply voltage and determines the instant at which the activation pulse must be stopped. This switch-over circuit made out of analog components is difficult to implement, proves to have low precision in use and has a considerable cost price.

Again, the document PATENT ABSTRACT OF JAPAN, vol. 9, No. 322 (M-440) [2045] Dec. 12, 1985 & JP-A-60 155 475 Aug. 8, 1985 describes a method for the control of the duration of a signal to activate resistive points of a print head wherein:

1) the activation device is delivered by a timing mechanism,
2) the supply voltage is sampled at a predetermined instant after the activation signal has been sent out,
3) the desired duration of the activation signal is then computed, 4) the desired duration of the activation signal, once computed, is sent to the timing mechanism which stops working when this duration is reached.

Thus, one drawback of the prior art methods is that they are complex to implement.

OBJECTS AND SUMMARY OF THE INVENTION

To mitigate this drawback, the present invention provides for a method of the type referred to here above, in which: the control signal comprises a first pulse with a fixed and predetermined duration followed by a second pulse with a variable duration, and the duration of the second pulse is determined in the duration of the first pulse as a function of the actual value of the supply voltage. Through the splitting up of the control signal into two successive pulses, the first one of which is a pulse with a constant duration, it becomes possible to make a system that is simple, precise, reliable and has an advantageous cost.

For example, the duration of the second pulse can be selected in an electronic memory in which several possible values of the duration of the second pulse are recorded.

According to one embodiment, the second pulse is added to the first pulse by means of an OR type logic gate.

BRIEF DESCRIPTION OF THE DRAWINGS

The characteristics and advantages of the present invention shall be seen more clearly in the following description of the method of the invention and several examples of implementation, given on a purely non-restrictive basis with reference to the appended figures of which.

DESCRIPTION OF THE PREFERRED EMBODIMENTS

Figure 1:
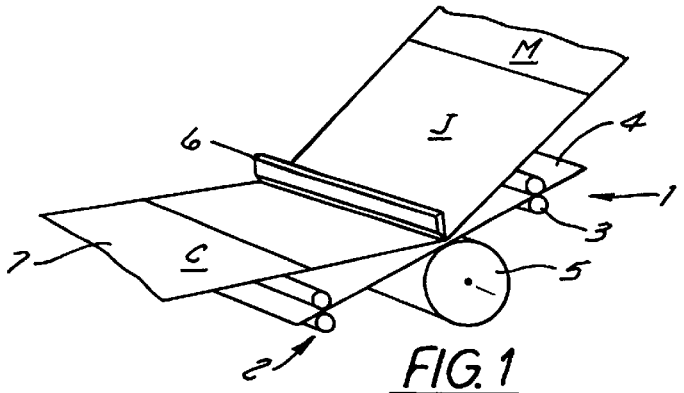
FIG. 1 provides a schematic view of a printing device using thermal transfer of dyes, and has been described here above.
Figure 2:
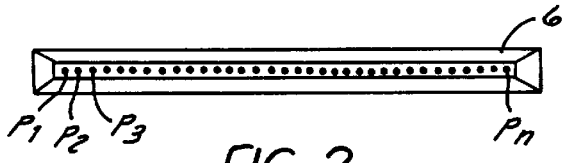
FIG. 2 shows a bottom view of a print head of the device of FIG. 1, and has been described here above, FIG. 3 provides a schematic view of the electrical structure of the print head of FIG. 2, and has been described here above.
Figure 3:
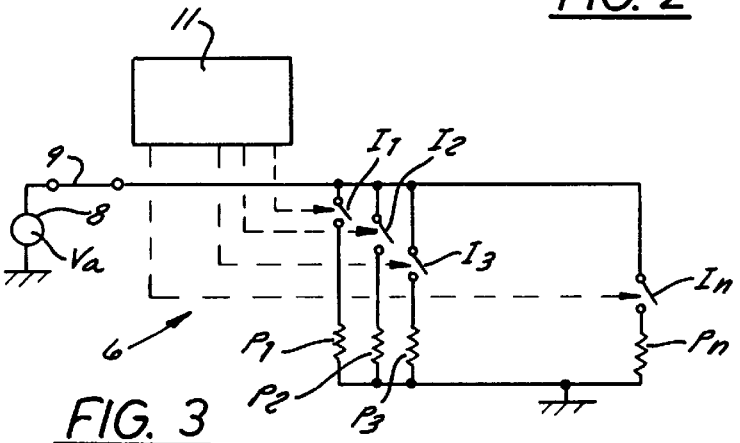
Figure 4:
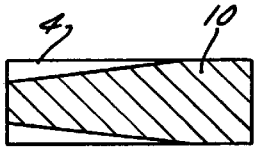
FIG. 4 shows a pattern printed on a plastic card and illustrates a problem resolved by the present invention.
Figure 5:
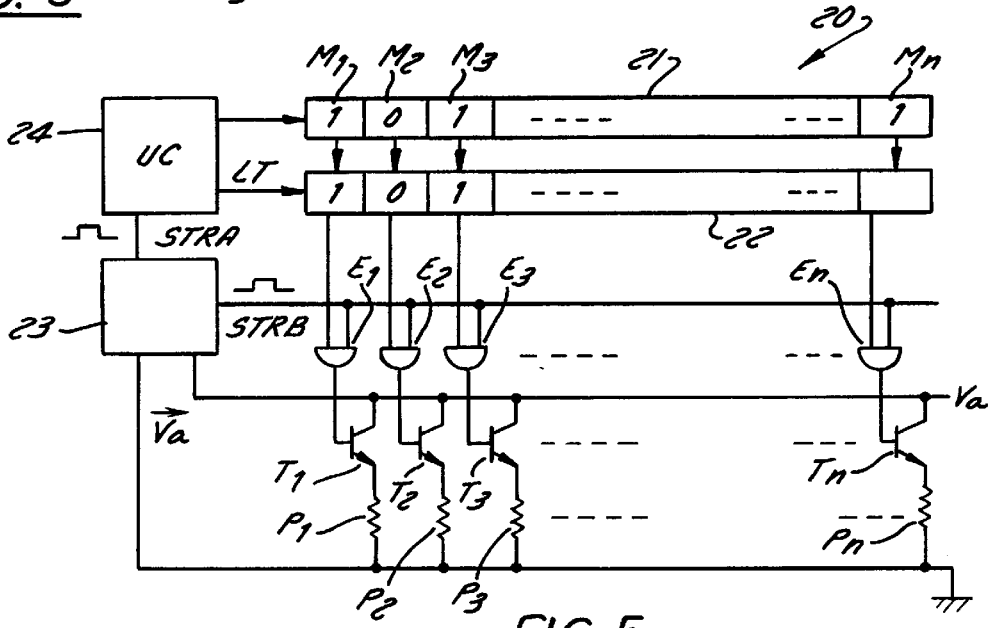
FIG. 5 shows the electrical diagram, in the form of blocks, of a print head according to the present invention, FIG. 6 gives a more detailed view of a block of FIG. 5.

FIG. 5 shows the electrical diagram of a print head 20 according to the present invention, that can be used in particular for the printing of a plastic card.

In the following description, when reference is made to one or more elements of a plurality of identical elements, then in order to simplify the document the letter <<i>> will be used as an index attached to the general designation of the plurality of elements, <<i>> being an index ranging from 1 to n, and n being the number of elements that the plurality of elements comprises.

The print head 20 comprises a plurality of heating resistive points $P_1$, $P_2$, . . . $P_n$, each resistive point $P_i$ being electrically connected to a source of supply voltage Va by means of a switch $T_i$ of a plurality of switches, which in this case are bipolar transistors $T_1$, $T_2$, . . . $T_n$. Each transistor $T_i$ is controlled by a logic gate $E_i$ of a plurality of AND type logic gates $E_1$, $E_2$, . . . $E_n$, and each AND gate receives, at a first input, a signal STRB to control the duration of a voltage pulse, common to all the other AND gates. The signal STRB is delivered by an electrical loss compensation circuit 23 according to the invention, which shall be described in detail further below. The other input of each AND gate receives the output of a memory cell $M_i$ of a plurality of memory cells $M_1$, $M_2$ . . . $M_n$ of a shift register 21, by means of a memory buffer 22 controlled by an enabling signal LT. All these elements are controlled by a microprocessor-based central processing unit 24 that has a model of the pattern to be printed in electronic memories.

A phase for the printing of a line includes a predetermined number N of cycles for the activation of the resistive points $P_i$, for example 255 cycles. At each cycle, the central processing unit 24 configures the shift register 21, activates the signal LT in order to validate the binary values contained in the memory cells $M_i$ of the register 21 at the output of the memory buffer 22, then sends a signal STRA to the input of the circuit 23 according to the invention which, upon reception of STRA, applies the signal STRB to the AND gates during a specified period of time.

During a cycle of activation, when a memory cell $M_i$ has been set at 1 by the central processing unit, and when the signal STRB is sent out, the corresponding AND gate goes to 1, the corresponding transistor $T_i$ is on and the corresponding resistive point $P_i$ is supplied with the voltage Va for the duration in which the signal STRB is at 1. The resistive point $P_i$ thus receives a voltage Va pulse that corresponds to an elementary quantity of energy e, it being possible to repeat this operation as many times as desired during the 255 cycles of a phase for the printing of a line. Thus, the total energy E received by a resistive point $P_i$ for the printing of a pixel is equal to the sum of the elementary quantities of energy e given by the operations for switching over the signal STRB.

Since N is herein equal to 255, the maximum energy Emax that can be applied to a resistive point $P_i$ is equal to 255 times the value of the elementary quantity of energy E, and the minimum energy Emin is null if the corresponding memory cell $M_i$ is never set at 1 during the 255 cycles. Ultimately, the temperature to which a resistive point $P_i$ is taken during a printing phase and, consequently, the intensity of the color of the pixel printed, depends on the number of voltage pulses received. This process is controlled by the central processing unit 24 through the sequences for programming the memory cells $M_i$ of the register 21.

In addition, the elementary quantity of energy e transmitted by a voltage pulse can be written as follows:

$$e=V^2T/R, \quad (1)$$

T being the duration of the voltage pulse, i.e. the period of time during which STRB is to 1, R being the electrical resistance of a resistive point $P_i$, all the resistive points having the same electric resistance R, and V being the actual value of the supply voltage Va during the activation of the resistive points $P_i$.

According to the present invention, the duration T of the voltage pulses is computed by the circuit 23 so that the elementary quantity of energy e transmitted by each pulse is constant in the presence of fluctuations in the supply voltage Va. Indeed, as was explained in the introduction, the actual value V of the supply voltage Va when the resistive points $P_i$ are activated is liable to drop proportionally to the number of resistive points $P_i$ that are simultaneously activated, because of various electrical losses by Joule effect.

A description shall now be given of the steps of the method of the invention seeking to determine mathematical relations that will be implemented by the circuit 23.

According to the invention, the relation (1) can be written as follows:

$$e=V^2T(V)/R=\text{constant}, \quad (2)$$

where T(V) signifies the fact that the duration T of a pulse is not a constant but a duration chosen as a function of the actual value V of the supply voltage Va so that e is a constant independent of the fluctuations of the voltage Va.

Using Vo to designate the nominal value of the supply voltage Va when no point $P_i$ is activated, Vo being a constant, the relation (2) can be also written as follows:

$$e=Vo^2To/R=V^2T/R \quad (3)$$

where To indicates the duration of a voltage pulse when the supply voltage Va is equal to Vo (with no point $P_i$ activated), To being a constant, and T the duration of a voltage pulse when Va is equal to V (with a certain number of points $P_i$ activated).

In order that the relation (3) may be verified, it is necessary that the ratio T/To should comply with the following relation:

$$T/To=(Vo/V)^2 \quad (4)$$

In other words, T should be equal to:

$$T=To(Vo/V)^2 \quad (5)$$

By writing V in the form:

$$V=Vo-\Delta V \quad (6)$$

ΔV representing the voltage drop (Vo−V) undergone by the supply voltage Va in relation to its nominal value Vo, the relation (5) can be now written as follows:

$$T=To(Vo/(Vo-\Delta V)^2) \quad (7)$$

To and Vo being constants, the relation (7) can enable the computation. from the variation in voltage ΔV undergone by the supply voltage Va, of the duration T that must be had by a voltage pulse in order to give the resistive points $P_i$ a constant quantity of energy.

However, from a practical point of view, the relation (7) cannot be directly exploited before the release of a pulse (STRB=1) since the variation in voltage ΔV will appear only after the release of the pulse, i.e. during the activation of the resistive points $P_i$. According to the invention, the duration T of a voltage pulse is expressed in the form:

$$T=To+t \quad (10)$$

and To is defined as an invariable basic duration of the signal STRB, for example the duration of the signal STRA delivered by the central processing unit 24, and t as a variable duration added to To in order to compensate for the electric losses and the reduction of the supply voltage Va, t being thus equal to 0 when Va is at its nominal value Vo.

By combining the relations (5) and (10), it is then possible to write:

$$T=To((Vo/V)2-1) \quad (11)$$

By combining the relations (6) and (11), and after simplifying and eliminating the second-order terms, a simplified expression is obtained with the form:

$$T=2To\Delta V/Vo \quad (12)$$

which proves to be sufficiently precise when the fluctuations ΔV are smaller than Vo, which is generally the case. For example, in practice, with a print head comprising 448 resistive points supplied with a voltage Va having a nominal value of 12 Volts (Vo), there is a maximum voltage drop of 300 mV for a current of 6 A when the 448 resistive points are activated simultaneously.

Figure 6:
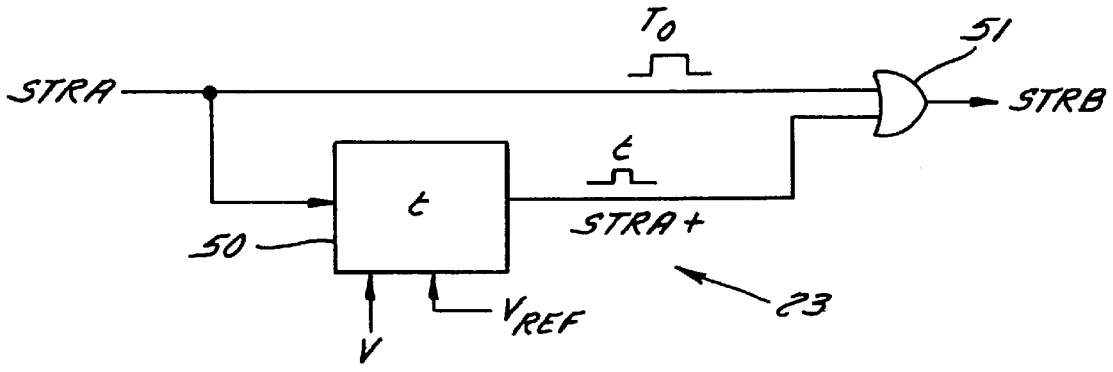

On the basis of the teaching that results from the relations (10) and (12), the present invention provides for an embodiment of the circuit 23 illustrated in FIG. 6. According to this embodiment, the circuit 23 comprises a circuit SO that receives, at input, a standard reference voltage Vref equal to Vo, as well as the actual value V of the supply voltage Va, taken for example at the terminals of the set of resistive points $P_i$. Upon the reception of a trailing edge of the signal STRA, the circuit SO delivers a signal STRA+ with a duration t, t being the duration of compensation determined according to the relation (12). The duration of STRA is the nominal fixed duration To of a pulse according to prior art not taking account of the fluctuations in the supply voltage. The signal STRA+ is added to the signal STRA by any suitable means to form the signal STRB, for example by means of an OR type logic gate 51. When the voltage drop ΔV of the supply voltage Va is null, i.e. when Va is equal to Vo, the signal STRA+ is not sent out and the duration of STRB is equal to that of STRA, i.e. To. When ΔV is not null, the signal STRA+ sent out on the trailing edge of STRA is added to the signal STRA, so that the total duration of STRB is equal to To+t.

Figure 7:
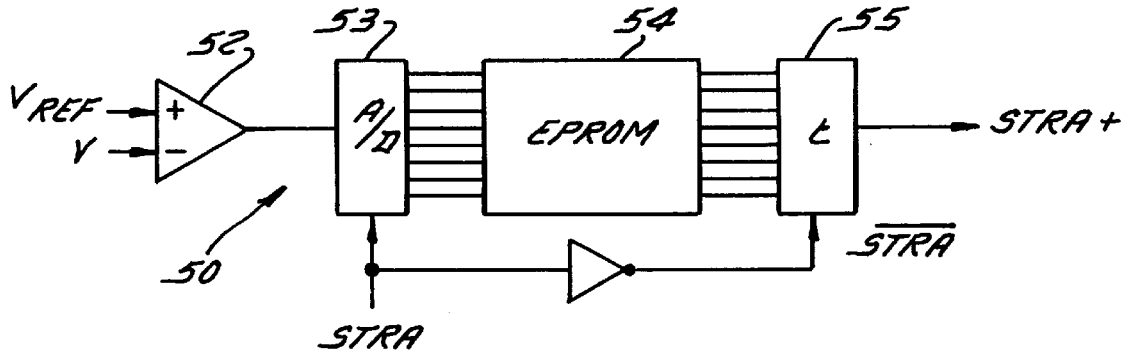
FIG. 7 shows an embodiment of an element of the drawing of FIG. 6.

FIG. 7 shows an embodiment of the circuit 50 made by means of digital circuits. The circuit 50 comprises a differential amplifier 52 receiving Vref at its positive input and V at its negative input. The amplifier 52 feeds the analog input of an analog/digital converter 53, herein a converter with a resolution of 8 bits, synchronized by the signal STRA. The output of the converter 53 is applied to the address inputs of an EPROM type memory 54 whose digital output is applied to the input of a monostable logic circuit 55, for example a countdown circuit, controlled by a signal /STRA that is the reverse of the signal STRA.

The memory 54 is used as a correspondence table in which there have been stored, for various values of fluctuations ΔV, corresponding values of the duration t of the signal STRA+, computed according to the relation (12). The internal organization of the memory S4 can therefore be represented by the following table 1.

TABLE 1

| Input Address | ΔVo | ΔV1 | ΔV2 | ΔV3 | ΔV4 | ΔV4 | . . . | ΔV256 |
|---|---|---|---|---|---|---|---|---|
| Duration t (STRA+) | to | t1 | t2 | t3 | t4 | t5 | . . . | t256 |

Since the memory 54 is controlled here by 8 address input bits (the resolution of the converter 53), in its memory zones 256 there have been stored different lengths of duration to, t1, t2, . . . t256 of the signal STRA+, corresponding to a breakdown of the fluctuations ΔV into 256 values ΔVo, ΔV1, ΔV2, . . . ΔV256. Thus, for a value of V, a particular value of ΔV is found at the output of the amplifier 52. The converter 53, upon reception of a leading edge of STRA, converts ΔV into a piece of digital data that corresponds to an address of a zone of the memory 54 and to a selection of a duration t of the signal STRA+. This value t is found in digital form at the input of the circuit 55. Upon reception of /STRA, the circuit 55 places its output STRA+ at 1 during a countdown time that depends on the value t selected. It can thus be seen that the duration t of STRA+ is chosen between the point in time when STRA passes to 1 and the point in time when STRA passes back to 0. Indeed, as already stated, it is necessary that the determination of the duration t of STRB should be done while the resistive points $P_i$ are activated. Otherwise, V would be always equal to Vo.

Figure 8:
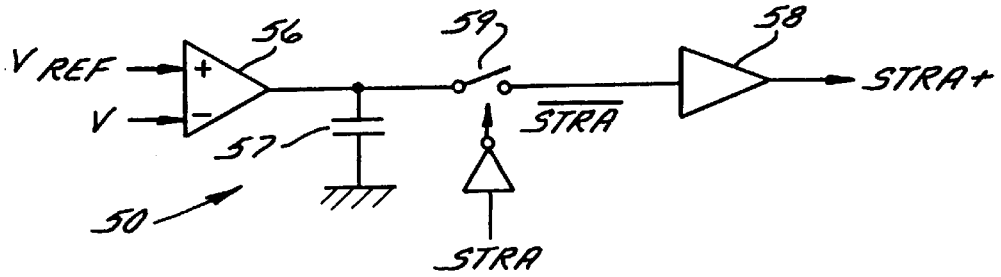
FIG. 8 shows another embodiment of an element of the drawing of FIG. 6.

Of course, the circuit 50 of the present invention can also be implemented by means of analog components, as shown in FIG. 8. FIG. 8 shows a differential amplifier 56 that computes ΔV from the actual voltage V and the voltage Vref (Vo). The output ΔV of the amplifier 56 is applied to a capacitor 57 connected to the input of an operational amplifier 58 by means of a switch S9. The switch 59, controlled by the signal/STRA which is the reverse of the signal STRA, is closed when STRA is at 0. The capacitor 57 gets charged when STRA is at 1 (duration To) and gets discharged when STRA passes to 0, the time of discharge being proportional to ΔV.

It will be clearly seen by those skilled in the art that the circuit 23 according to the present invention can as yet be the object of numerous alternative embodiments and improvements. For example, it would be possible to store, in the memory 54 of FIG. 7, values t that comply with the relation (11) instead of the relation (12), and to directly feed the converter 53 with the voltage V. These values can of course be computed from the relation (11) or determined experimentally.

Moreover, it has been considered until now, for the clarity of the description, that the circuit 23 is distinct from the central processing unit 24. However, in practice, there is nothing to stop the integration of the circuit 23 into the central processing unit 24. Also, there is nothing to stop the implementation of the method of the invention by means of computation algorithms that are carried out by the central processing unit and apply one of the above-described relations.

I claim:

1. Thermal printing method using a print head with a plurality of resistive points ($P_i$) activated by pulses of a supply voltage (Va) which is liable to fluctuate (ΔV) as a function of a number of simultaneously activated resistive points, an activation of the resistive points being controlled by a control signal (STRB) applied to the print head a time duration of the control signal being determined so that the energy (e) delivered to the resistive points by each of the voltage pulses is substantially constant and independent in a presence of fluctuations of the supply voltage, wherein the application of the control signal comprises the steps of:

a) applying a first control pulse (STRA) with a fixed time duration (To) to the print head, b) determining a duration (t) of a second control pulse (STRA+) during the fixed time duration of the first control pulse, c) applying the second control pulse to the print head when the first control pulse is over, and wherein the time duration of the second control pulse determined is a function of an actual value (V) of the supply voltage during the application of the first control pulse, so that the energy delivered to the resistive points by a successive application of the first control pulse and the second control pulse are substantially constant and independent in the presence of any fluctuations of the supply voltage.

2. Method according to claim 1, characterized in that the time duration of the second control pulse is determined as a function of a difference (ΔV) between a nominal value (Vo) of the supply voltage and the actual value of the supply voltage.

3. Method according to claim 1, characterized in that the time duration of the second control pulse is selected in an electronic memory (54) in which several possible values of the time duration of the second control pulse are recorded.

4. Method according to claim 1, characterized in that the time duration of the second control pulse is determined by the discharging of a capacitor (57).

5. Method according to claim 1, characterized in that the second control pulse is added to the first control pulse by means of an OR type logic gate (51).

6. Print head according to claim 1 wherein the first control pulse has a leading edge and a trailing edge and the second control pulse is applied on the trailing edge of the first control pulse.

7. Thermal print head comprising a plurality of resistive points activated by pulses of a supply voltage with energy that is substantially constant and independent in a presence of fluctuations of the supply voltage, the fluctuations depending on a total number of simultaneously activated resistive points, and comprising a first means (24) to deliver a first control pulse to control an activation of the resistive points, with the first control pulse having a fixed time duration, characterized in that the print head further comprises a second means (23, 50) to deliver a second control pulse to control the activation of the resistive points, with the second control pulse having a variable time duration determined during the fixed time duration of the first control pulse as a function of the actual value of the supply voltage.

8. Print head according to claim 7, characterized in that the second means comprise a memory circuit in which there is stored a plurality of possible values of the second control pulse.

9. A method of thermal printing using a thermal print head that has a plurality of pairs of resistive print elements that each is energized to produce heat by applying a pulse of electrical energy from a supply of electricity having a nominal supply voltage comprising:

a) applying a first portion of the pulse having a fixed time duration to one of the resistive print elements;

b) applying a second portion of the pulse having a variable time duration to the one of the print elements; and wherein the variable time duration of the second portion of the pulse depends upon a difference between the nominal supply voltage and an actual voltage actually applied to the one of the resistive print elements.

10. A method of thermal printing according to claim 9 wherein the first portion of the pulse has a leading edge and a trailing edge and the second portion of the pulse is applied on the trailing edge of the first portion of the pulse.

11. A method of thermal printing according to claim 9 wherein:

1) the pulse is applied for a total time duration of time comprising the fixed duration of the first portion of the pulse is applied in step a) and the variable time duration of the second portion of the pulse is applied in step b);

2) the nominal supply voltage comprises a voltage from the supply of electricity at a time when no resistive print element is energized;

3) the pulse is applied in steps a) and b) for a total duration of time that equals about twice the fixed duration of time multiplied by a ratio of the difference between the nominal supply voltage and the actual voltage divided by the nominal supply voltage.

12. A method of thermal printing according to claim 9 wherein:

1) the pulse is applied for a total duration of time, T, that is comprised of i) the fixed duration of time, To, the first portion of the pulse is applied in step a) and ii) the variable duration of time, t, the second portion of the pulse is applied in step b);

2) the nominal supply voltage, Vo, comprises the voltage, Va, of the voltage supply when no resistive print element is energized and the actual voltage, V, is the actual voltage of the pulse applied to the one of the print head elements; and 3) the pulse is applied in steps a) and b) for a total duration of time in accordance with the following formula:

$$T=T_o((V_o/V)^*2-1).$$

13. A method of thermal printing according to claim 9 wherein each of the resistive print elements comprises a resistive point in a print head that has as many as 255 of the resistive points.

14. A method of thermal printing using a print head having a plurality of resistive points energized by pulses of electricity from a supply having a supply voltage that fluctuates as a function of how many of the resistive points are simultaneously energized, wherein energization of the resistive points is controlled by a control signal applied to the print head, a time duration of the control signal being determined so that the energy delivered to the resistive points by each of the pulses is generally constant and substantially independent in a presence of fluctuations in the supply voltage, the method comprising:

a) applying a first control pulse of electricity having a fixed time and predetermined duration;

b) determining a time duration of a second control pulse of electricity while the first control pulse is being applied;

c) applying the second control pulse to the print head upon application of the first control pulse; and wherein the time duration of the second control pulse is determined as a function of an actual value of the supply voltage during the application of the first control pulse, so that energy delivered to the resistive points by a successive application of the first control pulse and the second control pulse is substantially constant and independent of any fluctuation in the supply voltage.

15. A method of thermal printing according to claim 14 wherein the first control pulse has a leading edge and a trailing edge and the second control pulse is applied on the trailing edge of the first control pulse.

16. A method of thermal printing according to claim 14 wherein the duration of the second control pulse is determined as a function of a difference between a nominal value of the supply voltage and the actual value of the supply voltage.

17. A method of thermal printing according to claim 16 wherein a value representing the time duration of the second control pulse is selected from an electronic memory in which a plurality of pairs of possible values representing the time duration of the second control pulse are stored.

18. A method of thermal printing according to claim 16 wherein the duration of the second control pulse is determined by an amount of time it takes for a capacitor to discharge.

19. A method of thermal printing according to claim 16 wherein the second control pulse is added to the first control pulse using an OR type logic gate.

20. A thermal print head comprised of a plurality of resistive elements energized by pulses of a supply voltage having a magnitude of electrical energy that is substantially constant and independent in a presence of fluctuations in the supply voltage, the fluctuations depending on a total number of substantially simultaneously energized resistive elements, and including:

a first means for delivering a first control pulse to control energization of the resistive elements, with the first control pulse having a fixed duration; and a second means for delivering a second control pulse to control energization of the resistive elements, with the second control pulse having a variable time duration determined during delivery of the first control pulse as a function of the actual value of the supply voltage.

21. A thermal print head according to claim 20 wherein the second control pulse delivery means comprises a memory in which there is stored a plurality of possible values that pertain to the time duration of the second control pulse.

* * * * *